US008499750B2

(12) United States Patent
Koyamaishi et al.

(10) Patent No.: US 8,499,750 B2
(45) Date of Patent: Aug. 6, 2013

(54) OIL MIST SEPARATOR FOR INTERNAL COMBUSTION ENGINE

(75) Inventors: Naoto Koyamaishi, Susono (JP); Tetsushi Suzuki, Mishima (JP); Motoichi Murakami, Gotenba (JP); Norio Inami, Susono (JP); Ryuji Koike, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 283 days.

(21) Appl. No.: 12/991,787

(22) PCT Filed: May 15, 2009

(86) PCT No.: PCT/IB2009/005617

§ 371 (c)(1),
(2), (4) Date: Nov. 9, 2010

(87) PCT Pub. No.: WO2009/138872

PCT Pub. Date: Nov. 19, 2009

(65) Prior Publication Data

US 2011/0056455 A1 Mar. 10, 2011

(30) Foreign Application Priority Data

May 16, 2008 (JP) ..... 2008-129998

(51) Int. Cl.
*F02B 25/06* (2006.01)
*F01M 11/03* (2006.01)

(52) U.S. Cl.
USPC ..... 123/573; 123/572; 123/574; 123/41.86; 123/196 A

(58) Field of Classification Search
USPC 123/196 A, 572–574, 41.86; 55/512; 264/86; 210/348, 500.1, 502.1, 506
See application file for complete search history.

(56) References Cited

U.S. PATENT DOCUMENTS

| | | | | |
|---|---|---|---|---|
| 3,241,537 | A * | 3/1966 | Jones | 123/572 |
| 3,529,719 | A * | 9/1970 | Gravbill | 210/714 |
| 4,089,309 | A * | 5/1978 | Bush | 123/573 |
| 4,136,650 | A * | 1/1979 | Manookian, Jr. | 123/573 |
| 4,607,604 | A * | 8/1986 | Kanoh et al. | 123/572 |
| 4,723,529 | A * | 2/1988 | Yokoi et al. | 123/573 |
| 5,750,026 | A * | 5/1998 | Gadkaree et al. | 210/502.1 |

(Continued)

FOREIGN PATENT DOCUMENTS

| | | | |
|---|---|---|---|
| CN | 1736543 | A | 2/2006 |
| CN | 2890362 | * | 4/2007 |

(Continued)

OTHER PUBLICATIONS

Translation: JP 2007-247448; Yoshifumi, D.; May 2008.*

(Continued)

*Primary Examiner* — Thanh K Truong
*Assistant Examiner* — Tea Holbrook
(74) *Attorney, Agent, or Firm* — Sughrue Mion, PLLC

(57) ABSTRACT

An oil mist separator (100) for an internal combustion engine that separates an oil component in a gas, which is introduced from a crankcase of the internal combustion engine, from the gas, includes a porous filter (150) that separates, from the gas, the oil component in the gas, the porous filter (150) being provided in a passage, through which the gas passes, and being coated with a counteragent for neutralizing an acid substance.

8 Claims, 6 Drawing Sheets

U.S. PATENT DOCUMENTS

| | | | | |
|---|---|---|---|---|
| 6,186,128 | B1 * | 2/2001 | Diotte et al. | 123/572 |
| 6,505,615 | B2 * | 1/2003 | Pietschner | 123/572 |
| 6,537,453 | B2 * | 3/2003 | Beard et al. | 210/206 |
| 6,684,864 | B1 * | 2/2004 | Busen et al. | 123/572 |
| 7,115,160 | B2 * | 10/2006 | Fitch et al. | 96/108 |
| 7,232,521 | B2 * | 6/2007 | Merritt et al. | 210/206 |
| 7,520,371 | B2 * | 4/2009 | Lockledge et al. | 184/6.21 |
| 7,614,390 | B2 * | 11/2009 | Holzmann et al. | 123/572 |
| 7,896,946 | B1 * | 3/2011 | Steffen et al. | 95/19 |
| 7,913,858 | B2 * | 3/2011 | Haberkamp et al. | 210/501 |
| 7,980,233 | B2 * | 7/2011 | Wagner et al. | 123/572 |
| 8,118,909 | B2 * | 2/2012 | Faber et al. | 95/19 |
| 2004/0139858 | A1 * | 7/2004 | Entezarian et al. | 95/275 |
| 2004/0154970 | A1 * | 8/2004 | Rohrbach et al. | 210/266 |
| 2006/0032814 | A1 | 2/2006 | Haberkamp et al. | |
| 2006/0261004 | A1 * | 11/2006 | Lockledge et al. | 210/502.1 |
| 2008/0223780 | A1 * | 9/2008 | Unger et al. | 210/435 |

FOREIGN PATENT DOCUMENTS

| | | | |
|---|---|---|---|
| CN | 2890362 | Y | 4/2007 |
| JP | 64-15852 | U | 1/1989 |
| JP | 06-146841 | A | 5/1994 |
| JP | 06-193424 | A | 7/1994 |
| JP | 2003-322052 | A | 11/2003 |
| JP | 2007-247448 | A | 9/2007 |
| JP | 2008-121474 | A | 5/2008 |
| WO | 94/24237 | A1 | 10/1994 |
| WO | 02/092193 | A1 | 11/2002 |
| WO | 2006/127652 | A2 | 11/2006 |
| WO | 2008/056831 | A1 | 5/2008 |

OTHER PUBLICATIONS

International Search Report for corresponding International Patent Application No. PCT/IB2009/005617 mailed Sep. 7, 2009.

Written Opinion for corresponding International Patent Application No. PCT/IB2009/005617 mailed Sep. 7, 2009.

Japanese Office Action for corresponding Japanese Patent Application No. 2008-129998 dated Mar. 9, 2010.

International Preliminary Report on Patentability for corresponding International Patent Application No. PCT/IB2009/005617 mailed Jun. 1, 2010.

Chinese Office Action issued on Jun. 4, 2012 in Chinese Patent Application No. 200980117688.9 with English language translation.

* cited by examiner

OIL MIST SEPARATOR FOR INTERNAL COMBUSTION ENGINE

BACKGROUND OF THE INVENTION

1. Field of the Invention

The invention relates to an oil mist separator for an internal combustion engine.

2. Description of the Related Art

It is known that when so-called blow-by gas, containing unburned fuel, that leaks through the gap between a piston and a cylinder into a crankcase is mixed with the oil in the crankcase, so-called sludge is produced, which significantly accelerates the deterioration of the oil. The main components of sludge are olefin (hydrocarbon) in the oil, and NOx and water in the blow-by gas, and such main components react with the help of heat and acid to produce a sludge precursor and a sludge binder, which in turn produce the sludge. Sludge looks to be a mud-like substance.

A positive crankcase ventilation (PCV) system is available that, in order to suppress deterioration of oil, introduces the blow-by gas in the crankcase into the inlet system to combust the unburned fuel in the blow-by gas (see Japanese Patent Application Publication No. 2003-322052 (JP-A-2003-322052)).

Because the blow-by gas in the crankcase contains an oil component, it is common that an oil mist separator is provided in the path along which the blow-by gas is introduced. In general, the oil mist separator includes a plurality of baffle plates therein. While the introduced gas passes through a gas passage that is defined by the baffle plates, the gas hits the baffle plates, the oil is thus separated from the gas, and the separated oil is returned into the crankcase.

However, there is a problem that such an oil mist separator does not effect sufficient separation of oil from the gas. Therefore, in Japanese Utility Model Publication No. 1-15852, a technology is described for compensating the insufficient capability of the baffle plates in separating the oil component, by providing a porous filter made of foam metal in the oil mist separator.

However, when a porous filter is provided in the oil mist separator, there is a possibility that sludge is produced and therefore clogging of the porous filter occurs. In particular, because the oil mist separator is exposed to the air, formation of condensed water easily occurs therein. Because the condensed water and NOx in the gas produce nitric acid, sludge is easily produced. There is a problem that when the porous filter clogs, the flow of gas is obstructed and the capability that the oil mist separator originally has is deteriorated.

SUMMARY OF THE INVENTION

The invention provides an oil mist separator for an internal combustion engine that efficiently separates an oil component from a gas in a crankcase and prevents the occurrence of a malfunction due to sludge produced.

An oil mist separator for an internal combustion engine according to an aspect of the invention is an oil mist separator for an internal combustion engine that separates an oil component in a gas, which is introduced from a crankcase of the internal combustion engine, from the gas, the oil mist separator being characterized by including a porous filter that separates, from the gas, the oil component in the gas, the porous filter being provided in a passage, through which the gas passes, and being coated with a counteragent for neutralizing an acid substance.

In the above aspect, a configuration may be adopted in which the oil mist separator further includes a binder provided on a surface of the porous filter, wherein the counteragent is dispersed and held in the binder.

In the above aspect, a configuration may be adopted in which the oil mist separator has a plurality of gas passages that are separate from each other, each of the plurality of gas passages is provided with the porous filter that is coated with the counteragent, and the oil mist separator further includes switching means that selects one of the plurality of gas passages as the gas passage, through which the gas is allowed to pass.

In the above aspect, a configuration may be adopted in which the oil mist separator further includes a controller that estimates the degree of decrease in the amount of the counteragent, based on information concerning the degree of decrease, and that, when the degree of decrease exceeds a predetermined degree, controls the switching means so as to change the gas passage through which the gas is allowed to pass.

In the above aspect, the information concerning the degree of decrease may include a mileage of a vehicle on which the internal combustion engine is mounted.

In the above aspect, a configuration may be adopted in which the porous filters provided in the plurality of gas passages are different in fineness of pores from each other.

In the above aspect, a configuration may be adopted in which the oil mist separator further includes a controller that changes the gas passage, through which the gas is allowed to pass, with the use of the switching means according to a flow rate of the gas, wherein the controller controls the switching means so that the higher the flow rate is, the finer pores the porous filter has that is provided in the gas passage selected by the switching means.

In the above aspect, a configuration may be adopted in which the porous filter coated with the counteragent is removable.

In the above aspect, a configuration may be adopted in which the counteragent is calcium carbonate.

In the above aspect, a configuration may be adopted in which the porous filter is made of foam metal or foam resin.

In the above aspect, a configuration may be adopted in which the porous filter is provided so that the degree of decrease in the counteragent coated can be seen from an outside.

With the invention, it is possible to efficiently separate an oil component from a gas in a crankcase and prevent the occurrence of a malfunction due to sludge produced.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

An example embodiment of the invention will be described below with reference to the attached drawings.

Figure 1:
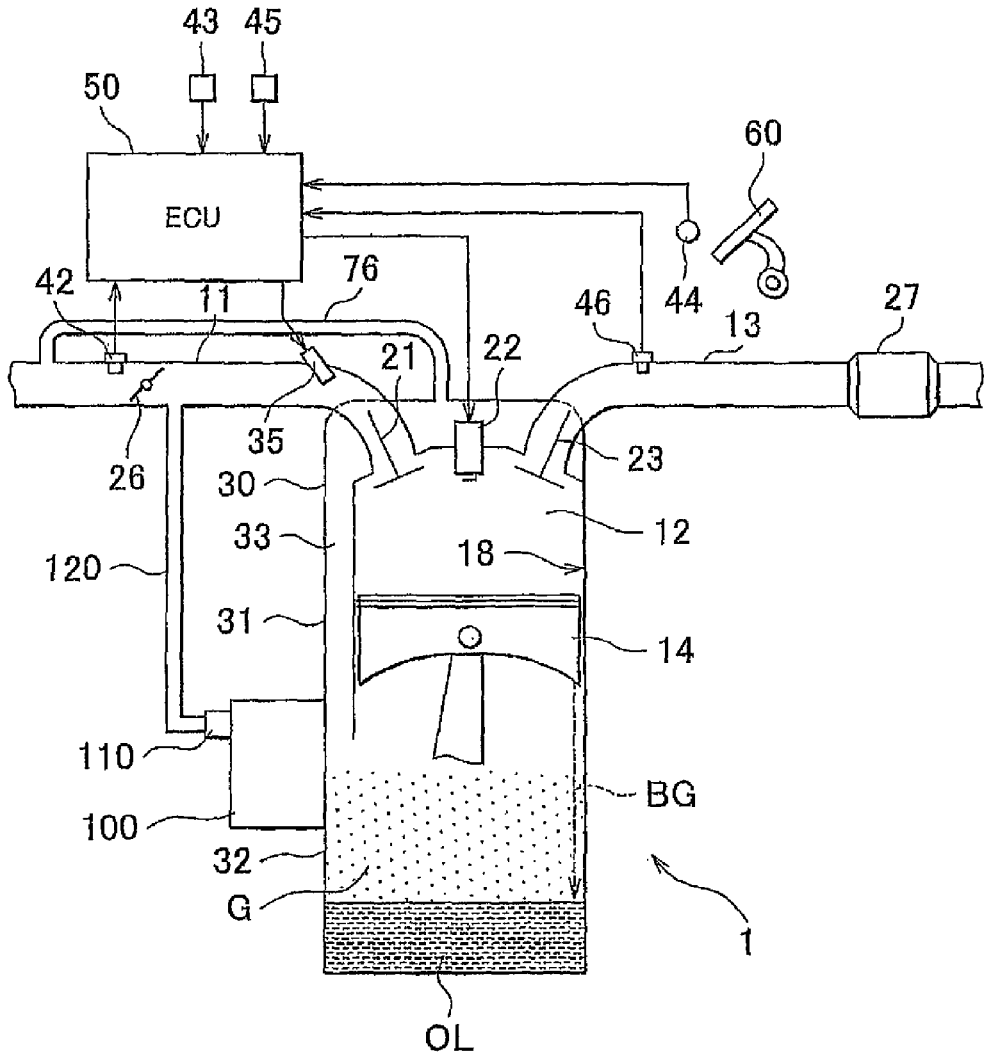
FIG. 1 is a schematic configuration diagram showing an example of an internal combustion engine to which the invention is applied.

FIG. 1 is a schematic configuration diagram of an internal combustion engine in which an oil mist separator according to an embodiment of the invention is used.

The internal combustion engine 1 includes a cylinder head 30, a cylinder block 31, and a crankcase 32 formed integrally with the cylinder block 31. In addition, the internal combustion engine 1 has an intake passage 11 for introducing intake air into the cylinder head 30 and an exhaust passage 13 for discharging exhaust gas from the cylinder head 30.

The internal combustion engine 1 further includes: a rotation speed sensor 43 that detects a rotation speed of a crankshaft (not shown); a water temperature sensor 45 that detects a temperature of cooling water for cooling the cylinder block 31; an intake air amount sensor 42 that is provided in the intake air passage 11 and detects the amount of intake air; an accelerator sensor 44 that is provided near an accelerator pedal 60 and detects the amount of depression (the accelerator opening degree); and an air-fuel ratio sensor 46 that is provided in the exhaust passage 13 and detects an air-fuel ratio.

The internal combustion engine 1 further includes: a throttle valve 26 that is provided in the intake passage 11 and regulates the amount of intake air introduced into a combustion chamber 12; a fuel injection valve 35 that is provided downstream of the throttle valve 26; and an ignition plug 22 provided in a cylinder 18 described later. An electronic control unit (ECU) 50 receives outputs from various sensors and controls the degree of opening of the throttle valve 26, the ignition timing of the ignition plug 22, the amount and the timing of injection of fuel injected from the fuel injection valve 35, etc. The ECU 50 performs air-fuel ratio feedback control in which the amount of fuel injection is controlled so that the air-fuel ratio detected by the air-fuel ratio sensor 46 is brought to the target air-fuel ratio.

In the cylinder block 31, a piston 14 is provided in the cylinder 18 so as to be able to reciprocate therein. The combustion chamber 12 is defined by an upper portion of the piston 14 and the cylinder 18. In the cylinder head 30, the combustion chamber 12 is connected to the intake passage 11 and the exhaust passage 13.

The intake air introduced through the intake air passage 11 is mixed with the fuel injected from the fuel injection valve 35 to form an air-fuel mixture, which is introduced into the combustion chamber 12 while an intake valve 21 is opened. After the air-fuel mixture is ignited by the ignition plug 22 and is thus explosively combusted, the combusted gas is discharged from the combustion chamber 12 into the exhaust passage 13 while an exhaust valve 23 is opened. The exhaust passage 13 is provided with a catalyzer 27 having a function of purifying exhaust gas.

The catalyzer 27 includes a three-way catalyst, for example, which reduces nitrogen oxides in the exhaust gas and oxidizes carbon monoxide and hydrocarbon (unburned fuel).

The crankcase 32 has the crankshaft (not shown) therein and retains a predetermined amount of engine oil OL (lubricating oil) in a bottom portion. The engine oil OL is supplied to various portions in the internal combustion engine by a lubricating oil supply system (not shown). The unburned fuel in blow-by gas BG that leaks through the gap between the cylinder 18 and the piston 14 is mixed with the engine oil OL.

The lubricating oil supply system includes an oil pump, a filter, an oil jet mechanism, etc. The engine oil OL in the crankcase 32 is sucked up through the filter by the oil pump and is supplied to the oil jet mechanism. In order to lubricate the interface between the piston 14 and the cylinder 18, the lubricating oil is supplied to the cylinder 18 by the oil jet mechanism.

In the internal combustion engine 1, the portion of the intake passage 11 upstream of the throttle valve 26 and the inside of the cylinder head 30 are communicated with each other through an atmospheric passage 76.

In the cylinder block 31, an oil dropping passage 33 that makes the cylinder head 30 and the crankcase 32 communicate with each other is formed. The oil dropping passage 33 is a passage for dropping, into the crankcase 32, the oil that in the cylinder head 30 after lubricating the valve system, and at the same time, the oil dropping passage 33 serves as a passage that supplies new air (atmospheric air) into the crankcase 32 through the atmospheric passage 76.

In the internal combustion engine 1, provided on one outer side face of the crankcase 32 is the oil mist separator 100 for separating an oil component in the gas G in the crankcase 32. The oil mist separator 100 turns, into droplets, the oil mist component in the gas G introduced from the crankcase 32 and returns it into the crankcase 32. The inner structure of the oil mist separator 100 will be described later. The gas G in the crankcase 32 is made up of the blow-by gas, including unburned fuel, nitrogen oxides, carbon dioxide, water vapor, etc. that escapes through the gap between the piston 14 and the cylinder 18, the vaporized fuel that is vaporized again from the state in which the fuel is mixed with the engine oil OL, the oil mist, etc.

A PCV valve 110 including a one-way valve is provided at the outlet of the oil mist separator 100, and the PCV valve 110 is connected to the portion of the intake passage 11 downstream of the throttle valve 26 by a gas passage 120. When the pressure in the intake passage 11 becomes a negative pressure that is lower than the atmospheric pressure, a difference in pressure occurs between the crankcase 32 and the intake passage 11, and such a pressure difference causes the PCV valve 110 to open and the gas in the crankcase 32 is circulated to the intake passage 11

Figure 2:
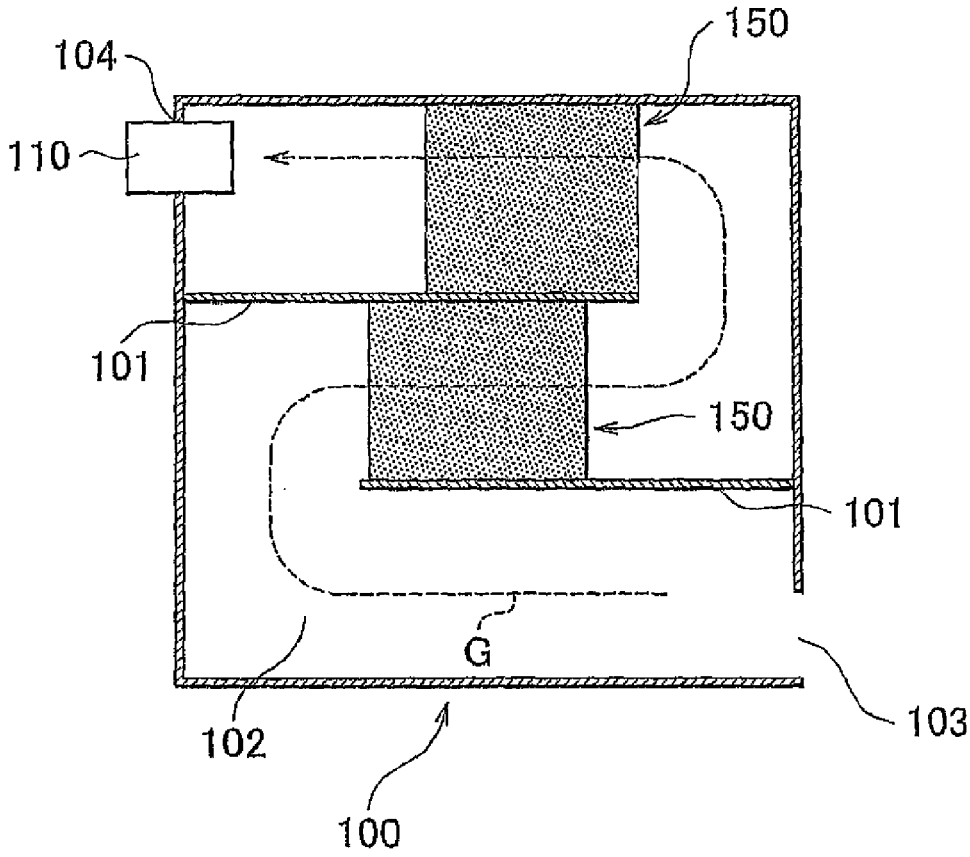
FIG. 2 is a schematic sectional view showing a structure of an oil mist separator according to an embodiment of the invention.

FIG. 2 is a schematic sectional view showing a structure of an oil mist separator according to the embodiment of the invention.

As shown in FIG. 2, in the oil mist separator 100, a plurality of baffle plates 101 are provided, which define a passage 102. The gas G from the crankcase 32 flows into the passage 102 through an inlet 103. The gas G that flows into the passage 102 flows out through the PCV valve 110 that is provided at an outlet 104.

A plurality of porous filters 150 are provided in the passage 102 so that the porous filters 150 fill part of the passage 102.

Figure 3:
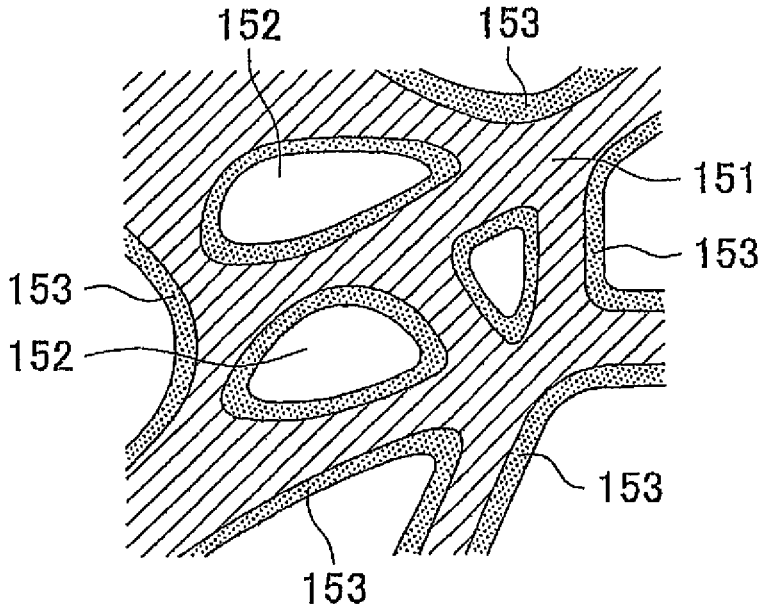
FIG. 3 is an enlarged sectional view showing a structure of a porous filter according to the embodiment of the invention.

As described in FIG. 3, the porous filter 150 is mainly formed of a base material 151 made of foam metal or foam resin having a large number of pores 152. Aluminum alloy, magnesium alloy, iron, etc. are used as the material for the foam metal. Polypropylene (PP), for example, is used as the material for the foam resin.

When the gas G passes through the porous filters 150 through the pores 152, the oil mist in the gas G is turned into droplets by virtue of the filtering function of the porous filter 150 and separated from other gas components, and is collected into the crankcase 32 (oil pan) through the oil collection passage (not shown).

Calcium carbonate 153, which serves as a counteragent for neutralizing acid substances, is applied to the base material 151 for the porous filter 150.

Because the oil mist separator 100 is exposed to the air, the temperature of the oil mist separator 100 tends to decrease and the water vapor in the gas G that passes through the oil mist separator 100 can be easily condensed and turned into condensed water. Therefore, in the oil mist separator 100, NOx in the gas G is dissolved in the condensed water, so that an acid substance containing nitric acid is produced. The acid substance causes production of sludge. When sludge is produced in the porous filter 150, the pores 152 of the porous filter 150 are filled with the sludge, which results in clogging of the porous filter 150. In order to prevent clogging of the porous filter 150, calcium carbonate 153 is applied to the porous filter 150 and production of sludge is prevented by neutralizing acid substance by means of calcium carbonate.

In order to apply the calcium carbonate 153 to the porous filter 150, that is, to fix the calcium carbonate 153 to the base material 151, for example, the base material 151 is immersed in a solution, in which calcium carbonate is dissolved, to impregnate the solution into the base material 151. Then, the porous filter 150 is taken out of the solution and dried by natural drying or by heating it in a heater. In this way, it is possible to fix the calcium carbonate 153 to the inside of the base material 151.

The size of the pores 152 of the porous filter 150 is determined by the thickness of the applied calcium carbonate 153.

However, as the calcium carbonate 153 applied to the porous filter 150 neutralizes the acid substance, such as nitric acid, the amount of the calcium carbonate 153 decreases due to the neutralization reactions. When the thickness of the calcium carbonate 153 decreases in this way, the size of the pores 152, that is, the pores through which the gas G passes become coarse. Thus, the pressure loss that is caused when the gas G passes through the porous filter 150 varies. When the pressure loss varies, the amount of gas G that circulates to the intake passage 11 and the separation efficiency of the oil mist separator vary.

Figure 4A:
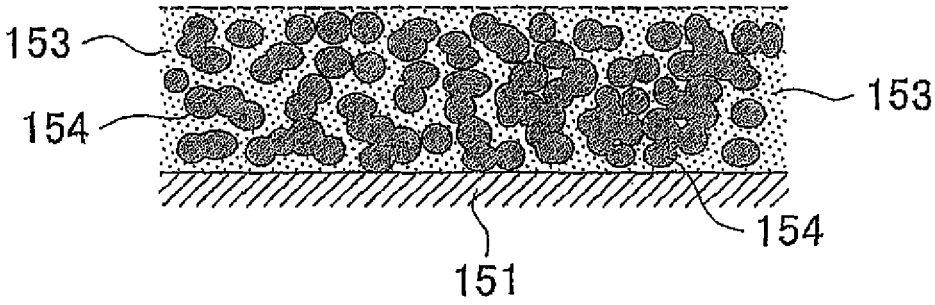
FIGS. 4A and 4B are diagrams for explaining a method of fixing calcium carbonate of a porous filter to a base material.
Figure 4B:
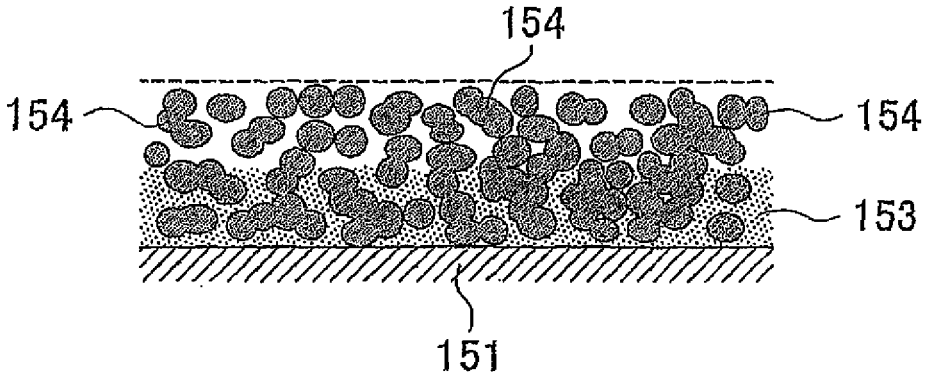

FIGS. 4A and 4B show another method of fixing calcium carbonate of the porous filter to the base material.

As shown in FIG. 4A, the calcium carbonate 153 is mixed with a binder 154 and retained on the surface of the base material 151. As the binder 154, urethane resin or the like, for example, can be used.

When the calcium carbonate 153 is dispersed in (mixed with) the binder 154 for retention, as shown in FIG. 4B, the shape of the binder 154 is kept even when the amount of the calcium carbonate 153 decreases due to neutralization reactions. Thus, even when the amount of the calcium carbonate 153 decreases, the size of the pores 152 varies little. Thus, it is possible to suppress the change in the pressure loss as the amount of the calcium carbonate 153 decreases in the porous filter 150, and it is therefore possible to suppress the change in the amount of the gas G that circulates to the intake passage 11 and in the separation efficiency of the oil mist separator.

Figure 5:
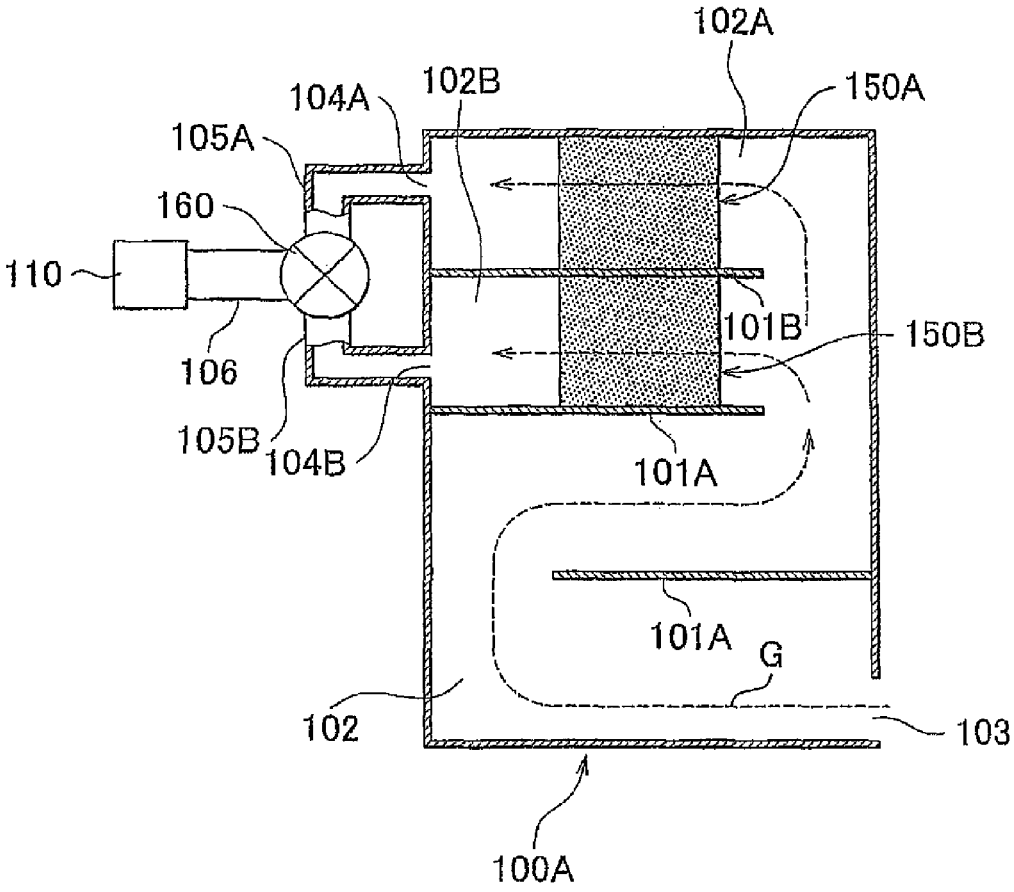
FIG. 5 is a schematic sectional view showing a structure of an oil mist separator according to another embodiment of the invention.

FIG. 5 is a schematic sectional view showing a structure of an oil mist separator according to another embodiment of the invention. In FIG. 5, the same reference numerals are used for the constituent elements the same as the corresponding constituent elements shown in FIG. 2.

As shown in FIG. 5, in the oil mist separator 100A, a plurality of baffle plates 101A are provided, which define a passage 102 through which the gas G flows. In an end portion of the passage 102, a baffle plate 101B is further provided that divides the passage 102 into two separate passages 102A and 102B. The gas G that passes through the passage 102A or 102B flows through outlet 104A or 104B, respectively, without flowing into the other passage.

Circulation pipes 105A and 105B are connected to the outlets 104A and 104B, respectively, and the circulation pipes 105A and 105B are connected to a circulation pipe 106 that is connected to the PCV valve 110 through a switching valve 160, which functions as a switching means.

The switching valve 160 selectively switches between a state in which the circulation pipe 105A and the circulation pipe 106 are connected and a state in which the circulation pipe 105B and the circulation pipe 106 are connected, based on the control command sent from the above-described ECU 50. Specifically, the switching valve 160 selects one of the circulation pipes 105A and 105B as the pipe, through which the gas G is allowed to pass, the circulation pipes 105A and 105B serving as the gas passages.

Porous filters 150A and 150B are provided in the separate two passages 102A and 102B so that the porous filters 150A and 150B fill part of the passages 102A and 102B, respectively.

The porous filters 150A and 150B have a structure similar to the porous filter described with reference to FIG. 3 or 4.

A method of controlling the switching valve 160 by the ECU 50 will now be described.

First, the ECU 50 controls the switching valve 160 so that the gas G does not flow through the passage 102B but flows through the passage 102 A. While the gas G passes through the passage 102A, the amount of the calcium carbonate applied to the porous filter 150A decreases. While the gas G passes through the passage 102A, the gas G does not pass through the passage 102B, and therefore, the amount of the calcium carbonate applied to the porous filter 150B does not decrease.

The ECU 50 estimates the degree of decrease in the amount of the calcium carbonate in the porous filter 150A based on the information, such as the mileage of the vehicle, for example. When the degree of decrease in the amount of calcium carbonate exceeds a predetermined degree, the ECU 50 controls the switching valve 160 so that the gas G does not pass through the passage 102A but passes through the passage 102B. In this way, it is possible to avoid a situation in which the calcium carbonate is completely consumed and sludge is produced in the porous filter 150A. Note that information other than the mileage of the vehicle can be used to estimate the degree of decrease in the amount of the calcium carbonate, as long as the information indicates a quantity related to the degree of decrease in the amount of calcium carbonate.

Alternatively, for example, porous filters 150A and 150B are provided that are different in average size of the pores. Specifically, filters that are different in fineness of the pores are used as the porous filters 150A and 150B.

The ECU 50 estimates the flow rate of the gas G based on, for example, the magnitude of the negative pressure that occurs in the intake passage 11 and controls the switching valve 160 based on the flow rate of the gas G, for example. When the flow rate of the gas G is high, for example, the amount of the oil mist in the gas G is also high, and therefore, a fine-pore filter is selected to efficiently turn the oil mist into droplets. On the other hand, when the flow rate of the gas G is low, the amount of the oil mist in the gas G is also low, and therefore, a coarse-pore filter is selected.

Figure 6:
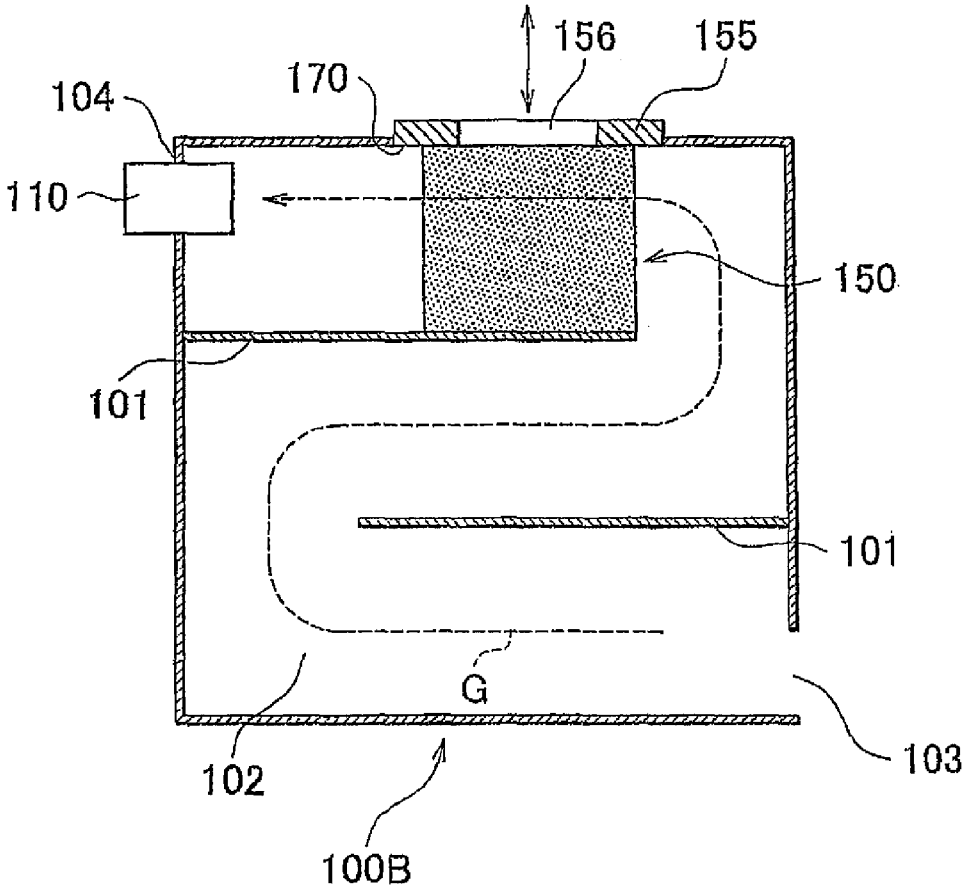
FIG. 6 is a schematic sectional view showing a structure of an oil mist separator according to another embodiment of the invention.

FIG. 6 is a schematic sectional view showing a structure of an oil mist separator according to another embodiment of the invention. In FIG. 6, the same reference numerals are used for the constituent elements the same as the corresponding constituent elements shown in FIG. 2.

The passage 102 of the oil mist separator 100B is provided with the porous filter 150. The porous filter 150 is retained by a retaining plate 155 at an upper portion of the porous filter 150.

Part of the retaining plate 155 is a transparent member 156, such as a glass plate.

In addition, an opening 170 for replacing the porous filter 150 is formed in an upper side portion of the oil mist separator 100B.

When the porous filter 150 is attached to the oil mist separator 100B, for example, the retaining plate 155 is fastened to a case of the oil mist separator 100B by fastening means, such as bolts, to seal the opening 170.

The degree of decrease in the calcium carbonate applied to the porous filter 150 can be seen from the outside through the transparent member 156.

Thus, users or the like can determine the degree of decrease in the calcium carbonate of the porous filter 150 by observing the porous filter 150 through the transparent member 156. When it is determined that the calcium carbonate is consumed and the neutralization capability is lost, it is possible to remove the porous filter 150 from the oil mist separator 100B by removing the fastening means, such as bolts, and replace the porous filter 150 with a new porous filter 150.

While the above-described embodiments illustrate examples in which the oil mist separator is provided outside the crankcase, the invention is not limited to the embodiments, and the invention can be also applied to the case where the oil mist separator is provided in the cylinder head cover, for example.

While the above-described embodiments illustrate the oil mist separators that are provided in the path in which the gas in the crankcase is circulated to the inlet system, the invention is not limited to the embodiments. For example, the invention can be applied to the case where the oil mist separator is provided in the path in, which the gas in the crankcase is circulated to the exhaust system.

The invention claimed is:

1. An oil mist separator for an internal combustion engine that separates an oil component in a gas, which is introduced from a crankcase of the internal combustion engine, from the gas, the oil mist separator comprising:

a porous filter that separates, from the gas, the oil component in the gas, the porous filter being provided in a passage, through which the gas passes, wherein the porous filter is coated with a counteragent for neutralizing an acid substance;

a plurality of gas passages that are separate from each other, each of the plurality of gas passages is provided with the porous filter that is coated with the counteragent;

a switching device that selects one of the plurality of gas passages through which the gas is allowed to pass;

a controller that estimates a degree of decrease in an amount of the counteragent, based on information concerning the degree of decrease, and that, when the degree of decrease exceeds a predetermined degree, controls the switching device so as to change the gas passage through which the gas is allowed to pass.

2. The oil mist separator according to claim 1, further comprising a binder provided on a surface of the porous filter, wherein the counteragent is dispersed and held in the binder.

3. The oil mist separator according to claim 1, wherein the information concerning the degree of decrease includes a mileage of a vehicle on which the internal combustion engine is mounted.

4. The oil mist separator according to claim 1, wherein the porous filters provided in the plurality of gas passages are different in fineness of pores from each other.

5. The oil mist separator according to claim 4, further comprising a controller that changes the gas passage, through which the gas is allowed to pass, with the use of the switching device according to a flow rate of the gas, wherein the controller controls the switching device so that the higher the flow rate is, the finer pores the porous filter has that is provided in the gas passage selected by the switching device.

6. The oil mist separator according to claim 1, wherein the counteragent is calcium carbonate.

7. The oil mist separator according to claim 1, wherein the porous filter is made of foam metal or foam resin.

8. The oil mist separator according to claim 1, wherein the porous filter is provided so that the degree of decrease in the counteragent coated can be seen from an outside.

* * * * *